US005282557A

United States Patent [19]

McCook

[11] Patent Number: 5,282,557

[45] Date of Patent: Feb. 1, 1994

[54] LIQUID CARRYING HARNESS

[76] Inventor: Joe R. McCook, Rte. 2, Box 159, Hiawassee, Ga. 30546

[21] Appl. No.: 972,898

[22] Filed: Nov. 6, 1992

[51] Int. Cl.[5] ..... A45F 3/16

[52] U.S. Cl. ..... 224/148; 222/175; 224/211; 224/215; 224/209

[58] Field of Search ..... 224/148, 151, 153, 208, 224/209, 211, 215, 223; 222/175; 141/18, 21, 2, 231; 137/572, 571, 575

[56] References Cited

U.S. PATENT DOCUMENTS

| | | | |
|---|---|---|---|
| 34,336 | 2/1862 | Sweeney | 222/175 |
| 357,272 | 2/1887 | Donavin | 224/148 |
| 2,558,181 | 6/1951 | Kassel | 222/175 |
| 4,544,087 | 10/1985 | Modig | 224/148 |
| 4,921,143 | 5/1990 | Billet | 224/148 |
| 5,085,349 | 2/1992 | Fawcett | 222/175 |
| 5,183,183 | 2/1993 | Hernandez | 224/148 |

*Primary Examiner*—Ernest G. Cusick
*Attorney, Agent, or Firm*—S. Michael Bender

[57] ABSTRACT

A harness supported bag adapted to be carried on the back of a person is adapted for storing a liquid refreshment such as water, fruit juice or the like. A tube extending from the bag to the front of the person enables the latter to draw liquid refreshment during ambulation. In one alternative embodiment, a transparent pocket is superposed over the bag for receiving indicia to identify the person during a race (e.g. a marathon) whereas in another alternatively preferred embodiment, supplementary reservoir means are provided having a passage connected to the bag and manually activatable valve means for selectively enabling a person to transfer the contents of the supplemental reservoir to the bag during running or other physical activity.

1 Claim, 5 Drawing Sheets

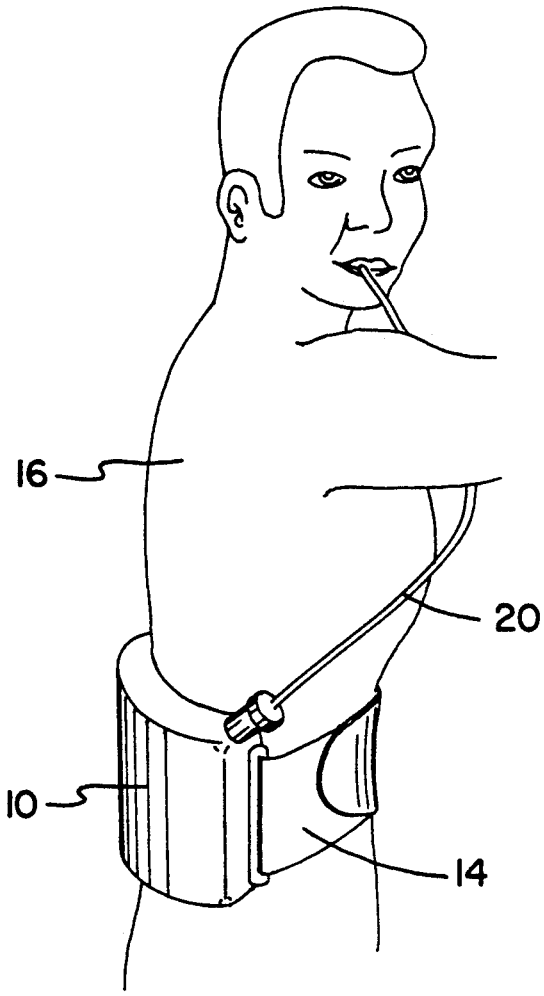
FIG. 1
PRIOR ART
FIG. 2
PRIOR ART
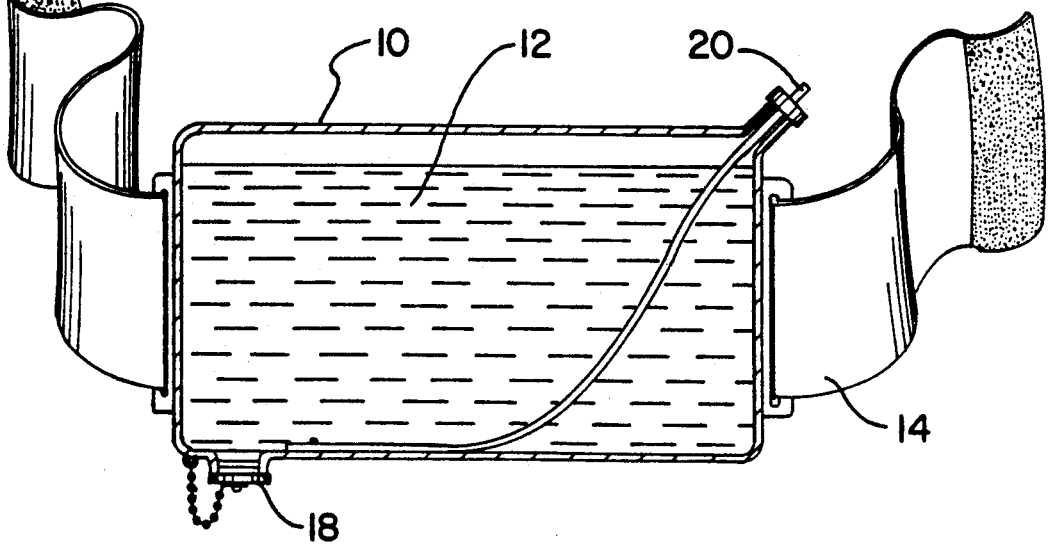

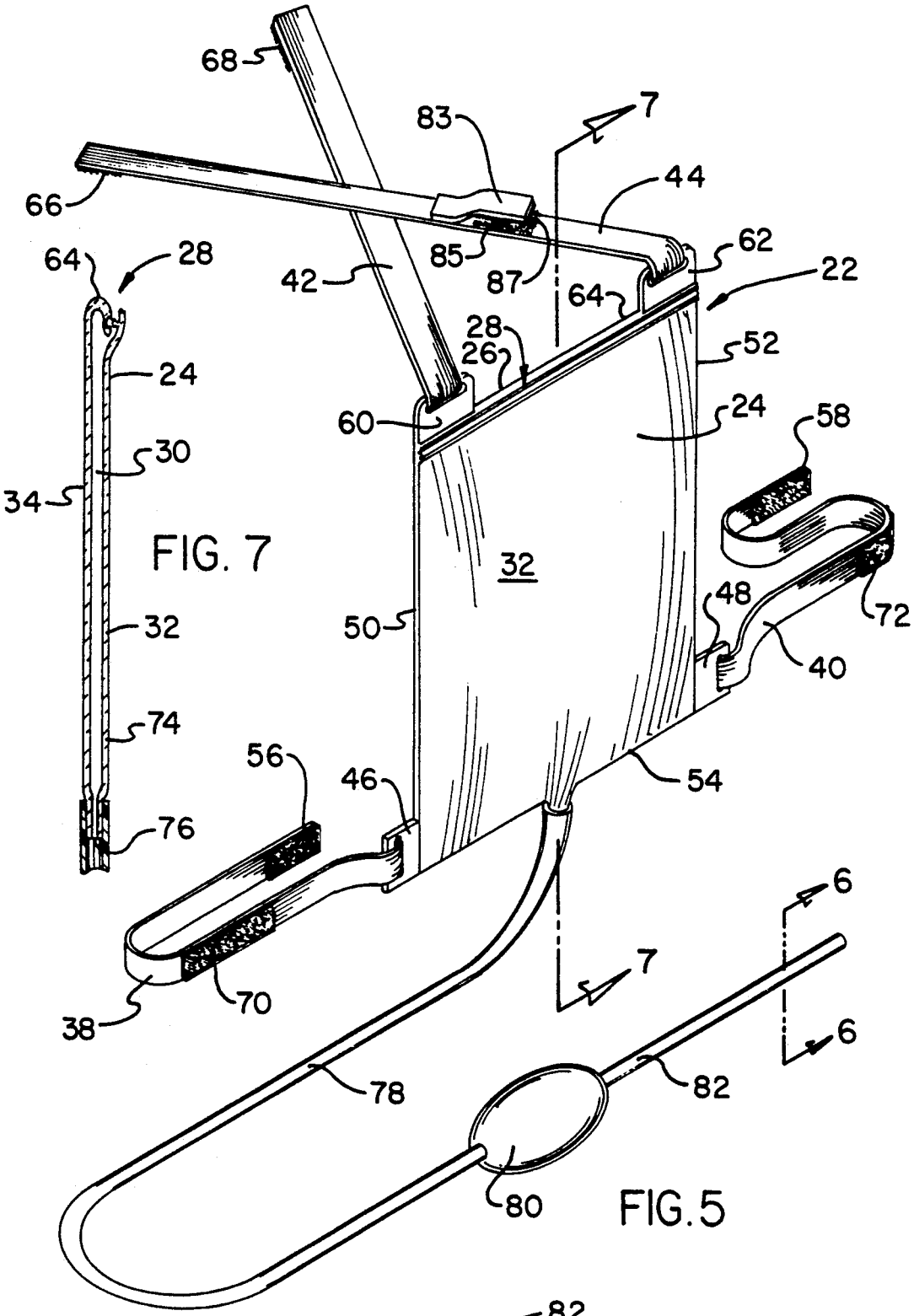
FIG. 7
FIG. 5
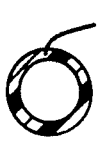
FIG. 6

LIQUID CARRYING HARNESS

BACKGROUND OF THE INVENTION

1. Field of the Invention

The present invention relates generally to portable fluid containers, and more particularly, to a fluid container adapted to be carried on the back of a person by means of a harness and which is especially adapted to carry a liquid refreshment during vigorous physical activity such as running or hiking.

2. Description of the Prior Art

Portable containers for liquid refreshment adapted to be worn by a person during physical activity are quite well known. The so-called "canteen" for carrying a supply of water and worn on a belt around the waist is useful when walking or hiking. However, this form of portable liquid container is totally unsuitable for a long distance runner or jogger desiring to consume liquid refreshment while "on the run" so to speak. U.S. Pat. No. 4,090,650 discloses a "canteen" adapted to be worn about the waist by means of a belt and includes a flexible straw extending long enough from the canteen to the wearer's mouth to enable drinking during running activity. Nonetheless, since this form of portable container is worn about the waist, it interferes with the wearer's running motion, and further, is susceptible of shifting on the runner's body or becoming loose and even falling off during a race.

Thus, there exists a need for a portable container adapted to carry a liquid refreshment or other consumable fluid which may be employed by a user during vigorous physical activity such as running in a marathon race, for example, and which may be worn in a more non-restrictive manner than prior art "canteen" and thus, minimize inhibiting the normal running motion of the user. This need is met by the present invention as will be made apparent from the following description thereof. Other advantages of the present invention over the prior art also will be rendered evident.

SUMMARY OF THE INVENTION

To achieve the foregoing and other advantages, the present invention, briefly described, provides a harness-supported bag adapted to be carried on the back of a person and which is adapted for storing a liquid refreshment such as water, fruit juice or the like. A flexible tube extending from the bag to the front of the person enables the latter to draw liquid refreshment during ambulation. In one alternative embodiment, a transparent pocket is superposed over the bag for receiving indicia to identify the person during a race (e.g. a marathon) whereas in another alternatively preferred embodiment, supplementary reservoir means are provided having a passage connected to the bag and manually activatable valve means for selectively enabling a person to transfer the contents of the supplemental reservoir to the bag during running or other vigorous physical activity.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least three preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved liquid carrying harness which has all of the advantages of the prior art and none of the disadvantages.

It is another object of the present invention to provide a new an improved liquid carrying harness which may be easily and efficiently manufactured and marketed.

It is a further objective of the present invention to provide a new and improved liquid carrying harness which is of durable and reliable construction.

An even further object of the present invention is to provide a new and improved liquid carrying harness which is susceptible of a low cost of manufacture with regard to both materials and labor, and which accordingly is then susceptible of low prices of sale to the consuming public, thereby making such liquid carrying harness available to the buying public.

Still yet a further object of the present invention is to provide a new and improved liquid carrying harness adapted to be fitted about the upper torso of a wearer and to support a fluid carrying bag or other container on the back of the wearer.

It is still a further object of the present invention to provide a new and improved liquid carrying harness especially adapted for use during vigorous physical activity and which includes means for enabling the wearer to draw liquid refreshment therefrom during ambulation.

It is still a further object of the present invention to provide a new and improved liquid carrying harness which minimizes restricting a wearer engaged in running or other vigorous physical activity.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 1 is a perspective view showing a prior art canteen adapted used during running or other physical activity.

FIG. 2 is a plan an elevational view partly in section of the prior art canteen of FIG. 1.

FIG. 5 is a perspective view of the embodiment of FIGS. 3 and 4.

FIG. 6 is a cross-sectional view taken along line 6—6 of FIG. 5.

FIG. 7 is a cross-sectional view taken along line 7—7 of FIG. 5.

DESCRIPTION OF THE PREFERRED EMBODIMENT

Figure 3:
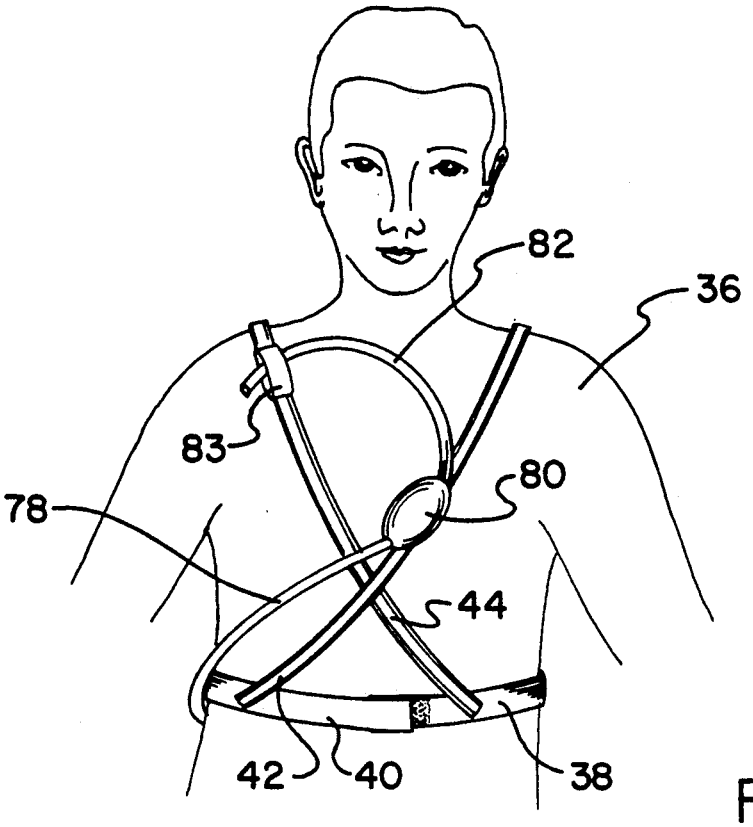
FIG. 3 is a front elevational view of the first preferred embodiment of the invention shown being worn by a user.

With reference now to the drawings, a new and improved liquid carrying harness embodying the principles and concepts of the present invention will be described.

It might be helpful however, to first describe a typical prior art canteen which as shown in FIGS. 1 and 2 comprises a container or reservoir 10 for a liquid substance 12 attached to a belt 14 adapted to be fastened generally about the waist of a user 16. The bag includes a removable cap 18 for facilitating refills and a flexible straw 20 extending between the bag and the user's mouth thereby permitting the user to drink the fluid substance stored in the bag while ambulating in a manner believed apparent.

Turning now to FIGS. 3–7, there is shown a first exemplary embodiment of the liquid carrying harness of the invention generally designated by reference numeral 22. In its preferred form, liquid carrying harness 22 comprises a generally rectangular shaped bag 24 preferably of a translucent or transparent flexible plastic material such as polyvinyl chloride (PVC), although other known, flexible liquid impervious materials may be used instead. As best seen in FIGS. 6 and 7, bag 24 includes proximal to its top edge 26 a transverse seam openable and closeable by a fastener generally designated by reference numeral 28 extending substantially the full transverse extent of the bag which fastener comprises in its preferred form the type featuring a narrow ridge frictionally engaging a complimentary groove such as sold under the Registered Trademark ZIP LOK. By means of fastener 28, the top of bag 24 may selectively be opened and closed (fastened) thereby facilitating the filling of the interior 30 of the bag with a liquid substance (e.g. water, fruit juice, salt solution, or the like) through the opening at the top of the bag defined by transverse fastener 28. When filled with a liquid substance, the opposed walls 32, 34 of the bag will generally distend slightly with respect to each other.

In accordance with the present invention, bag 24 is supported adjacent the back of a user 36 generally between the user's waist and shoulder blades by a harness comprising a first pair of opposed, flexible belt strap members 38, 40 and a second pair of spaced, flexible shoulder strap members 42, 44. Each belt strap member has one end thereof suitably attached to a tab 46, 48, respectively, extending laterally from opposed edges 50, 52 of bag 24 with the bottom edges of the tabs 46, 48 being generally aligned with the bottom edge 54 of the bag substantially as shown. The distal or other ends of belt strap members 38, 40 have fastener elements 56, 58 suitably attached thereto respectively, which fastener elements preferably are of the mating fabric hook and loop variety sold under the Registered Trademark VELCRO, and which permit the distal ends of the belt strap members to be fastened to each other about the waist of the user (FIG. 3).

Similarly, each shoulder strap member has one end thereof suitably attached to a tab 60, 62, respectively, extending upwardly top edge 64 of bag 24 with the side edges of the tabs 60, 62 being generally aligned with the side edges 50, 52 of the bag, respectively, substantially as shown. The distal or other ends of shoulder strap members 42, 44 have fastener elements 66, 68 suitably attached thereto respectively, which fastener elements also preferably are of the mating fabric hook and loop variety sold under the Registered Trademark VELCRO, and which permit the distal ends of the belt strap members to be fastened to complimentary fastener elements 70, 72 located on belt straps 38, 40, respectively, proximal to the distal ends of the belt strap members (see FIG. 3). It will be appreciated that the individual lengths of belt straps 38, 40 are such as to fit an average adult, but optionally may be provided with suitable length adjusting means (not shown) such as an axial section of elastic material. Likewise, the length of shoulder straps 42, 44 is such that when they are criss-crossed in the front or chest area of the user as schematically depicted in FIG. 3 they will permit ready engagement of fastener elements 66, 68 and 70, 72 substantially as shown. Here again, it is apparent that each shoulder strap optionally may be provided with a suitable strap length adjusting means (not shown) such as an axial section of elastic material.

Extending downwardly from bottom edge 54 of bag 24 is nipple 74 having an opening 76. A first flexible section of tubing 78 has one end thereof suitably attached to nipple 74 and the other end thereof attached to one end of a conventional hollow, flexible squeeze bulb 80 which is adapted to serve as a pumping means for facilitating the flow of the liquid substance contained in the interior 30 of bag 24 through flexible tubing first section 78 and the bulb 80 and eventually through the open end of a second section of flexible tubing 82 having an end opposite to its open end suitably fastened to the other end of the bulb 80 substantially as shown. Hence when running, jogging, hiking, etc. the wearer may place the open end of second tube section 82 in his/her mouth, squeeze bulb 80 and pump liquid from bag 24 into his/her mouth as required. A flexible fastening element 83 attached to shoulder strap 44 substantially as shown has a VELCRO fastener 85 at its distal free end for mating with a complimentary VELCRO fastener 87 suitably located on the shoulder strap. Thus, when not being used to transfer liquid from bag 24 to the user for consumption thereby while the latter is wearing the harness of the invention, the first flexible tube section 78, squeeze bulb 80 and the second flexible tube section 82 may be fixed in the position substantially as shown in FIG. 3.

Figure 4:
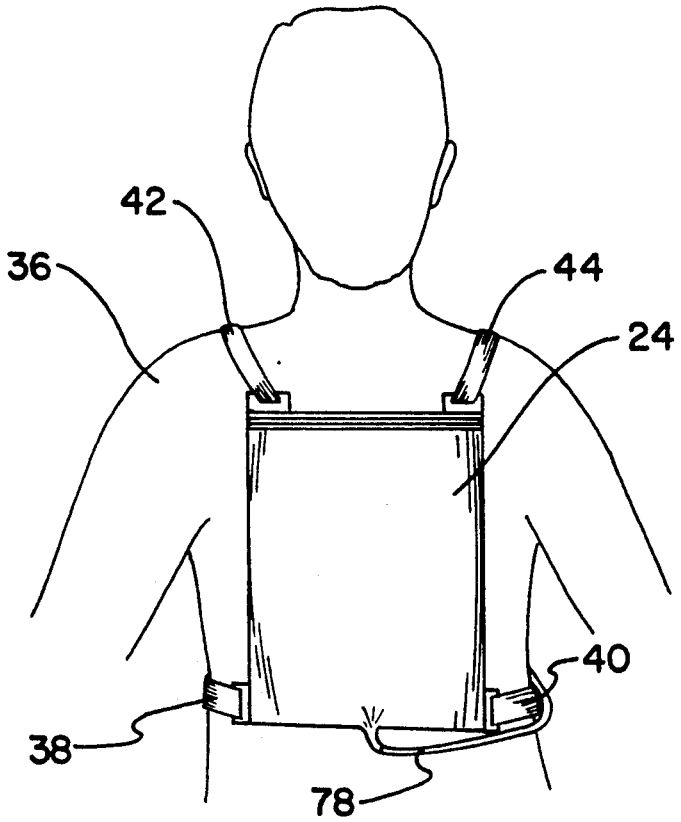
FIG. 4 is a rear elevational view of the first preferred embodiment of the invention shown being worn by a user.

In operation, the harness is worn about the upper torso of a user with strap members 38, 40 attached to each other about the waist, and with shoulder strap members 42, 44 attached to strap members 40, 38, respectively, as shown in FIGS. 3 and 4. Bulb 80 and flexible tube sections 78, 82 are normally maintained in fixed non-used position by fastener 83, but may used to draw liquid from bag 24 during running or other physical activity by releasing fastener 83, placing the free end of flexible tube in the mouth of the user and then squeezing bulb 80 in a manner believed readily apparent.

Figure 8:
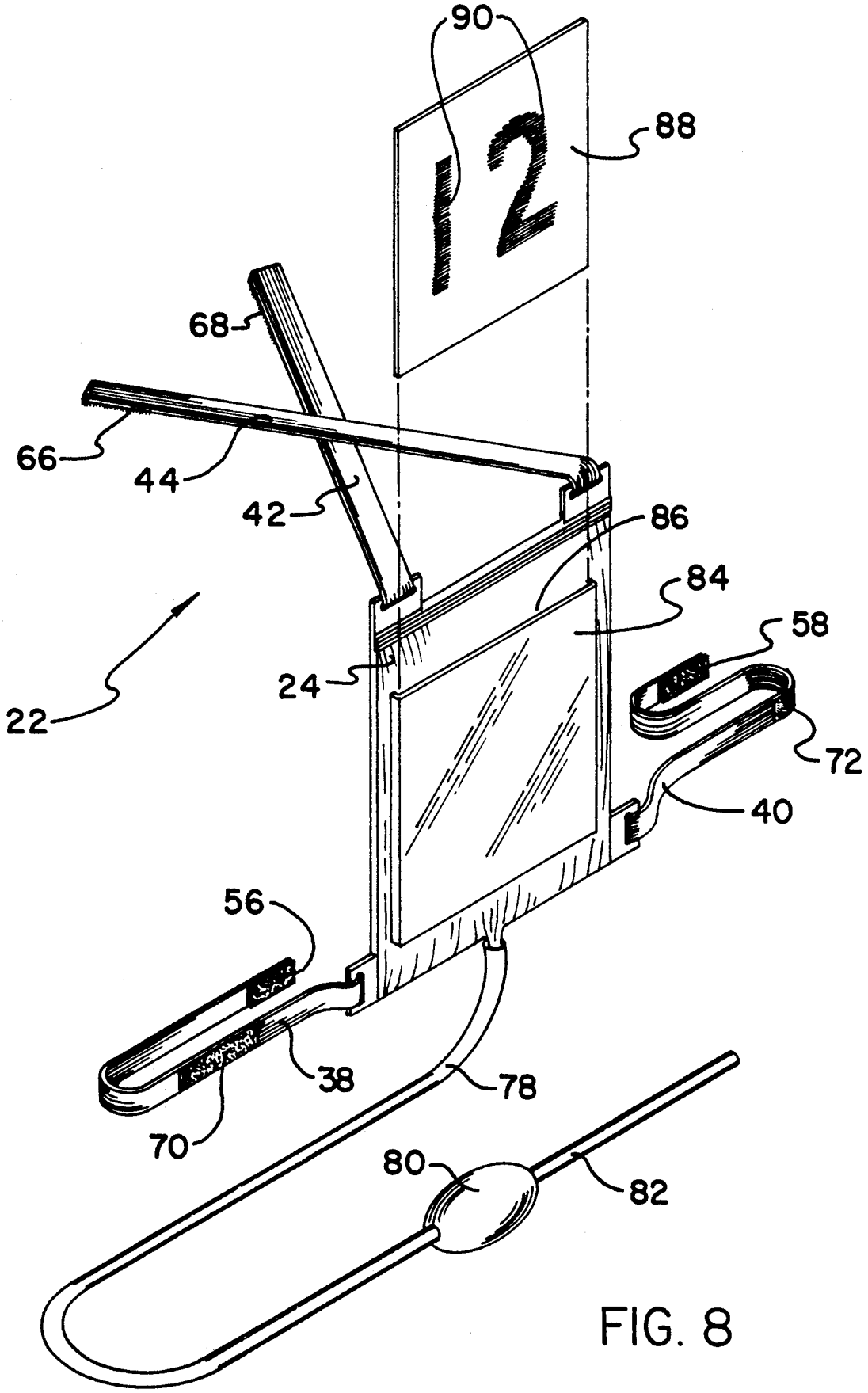
FIG. 8 is a perspective view of an alternatively preferred embodiment of the invention.

Turning to FIG. 8, a slightly modified version of the invention is shown wherein like parts are represented by like reference numerals. In this alternatively preferred form of the invention, a transparent pocket formed by a panel 84 having three closed sides an open top side 86 is suitably attached to the outwardly facing wall 32 of bag 24. A placard 88 bearing identifying indicia 90 may then be positioned inside the pocket defined by panel 84 where it will be plainly visible during a marathon race, for example, to identify the user of the harness of the invention in a manner believed apparent. Placard 88, of course, is removable and replaceable so that different identifying indicia may be employed on different occasions.

Figure 10:
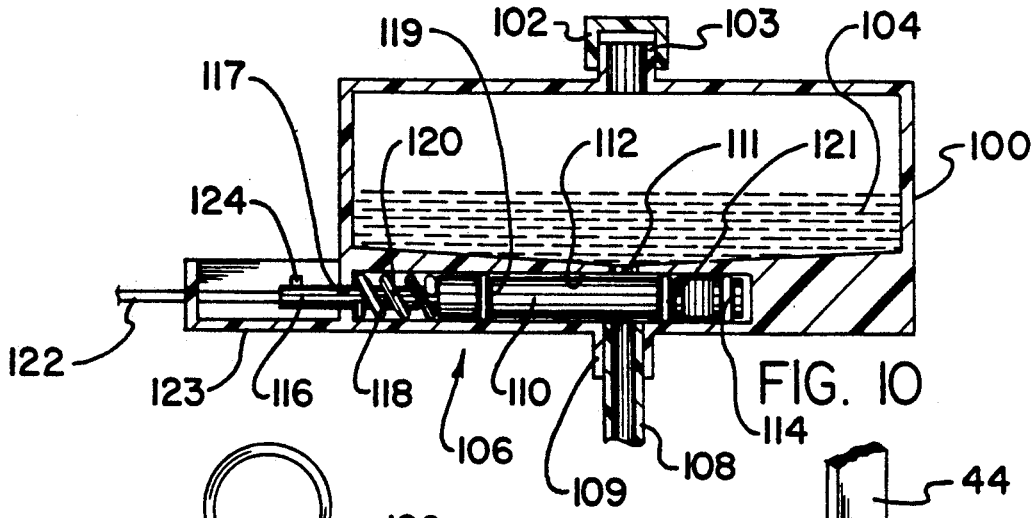
FIG. 10 is a cross-sectional view taken along line 10—10 of FIG. 9.
Figure 9:
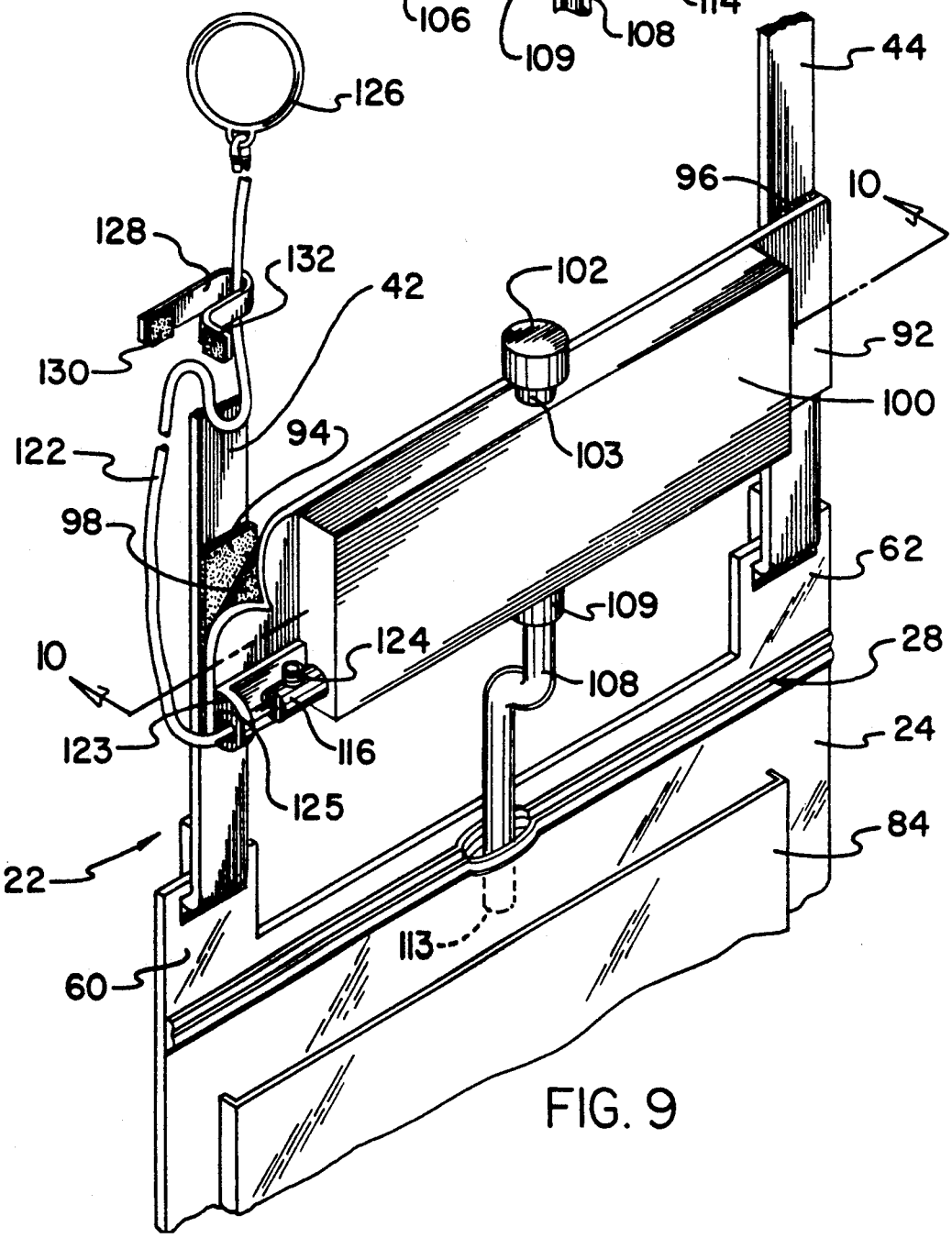
FIG. 9 is a perspective view of yet another alternatively preferred form of the invention.

Referring now to FIGS. 9 and 10, there is shown another alternatively preferred embodiment where again like reference numerals are used to represent common parts already described. In this variation of the invention, a supplement liquid carrying reservoir or container 100 is provided and is adapted to be mounted on straps 42, 44 via supplemental flexible panel 92 which extends transversely with respect to shoulder straps 42, 44 proximal to the transverse opening defined by ZIP-LOK fastener 28 substantially as illustrated in FIG. 9. Supplemental reservoir or container 100 is suitably attached to supplemental panel 92 which, in turn, is removably attached to shoulder straps 42, 44. The preferred panel attachment means comprises a pair of VELCRO fastening elements 96, 98 located on shoulder straps 44, 42, respectively, and a layer 98 of complimentary VELCRO fastener material on the underside of panel 92. The supplemental container 100 also includes a filling tube 103 extending upwardly therefrom which tube is normally closed by a removable cap 102 suitably threadedly fastened to the filling tube extremity and which provides means for replenishing the contents of the supplemental reservoir when and as desired.

In accordance with the invention, a manually activatable valve assembly generally designated by reference numeral 106 is provided on supplemental container 100 so that the user may selectively cause the liquid substance 104 contained in the supplemental reservoir to be transferred to bag 24 where it mixes with the fluid contained in the bag. In this manner, an enrichment fluid may selectively be added to the contents of bag 24 when necessary on an "on demand" basis by activating valve assembly 106. An example of a suitable enrichment fluid is a concentrated sucrose (sugar) solution containing dissolved minerals such as is sold under the Registered Trademark GATORADE.

Valve assembly 106 is effective to transfer liquid substance 104 from container 100 through an opening 111 which communicates with one end of a flexible tube 108 suitably attached to and received in a downwardly extending nipple 109 integral with the bottom of supplemental container 100. The other end 113 of tube 108 extends into the bag 24 through the opening therein defined by ZIP-LOK fastener 28. Extending laterally in the bottom wall section of supplemental reservoir 100 is cylindrical axial passage 112 intercepting and extending between opening 111 and nipple 109. A valve slide member 110 is positioned to slide axially in passage 112 between a first position blocking flow of solution 104 through opening 111 and nipple 109 (FIG. 10) and a second position where the through hole 114 provided proximal to the rightmost end of valve slide member 110 is axially aligned between and with opening 111 and nipple 109. A valve stem of reduced diameter 116 exits the supplemental container 100 on the left side thereof as viewed in FIG. 10 via opening 117 and includes a recess therein for receiving one end of a flexible pull cord 122 maintained securely affixed therein by threaded set screw 124 with the pull cord being trained through opening 125 in guide flange 123 and with the other end of pull 122 being suitably attached to pull ring 126 substantially as depicted in FIGS. 9 and 10. Pull cord 122 is of sufficient length so that it may be draped over the shoulder of the user when the harness of the invention is worn to an easily reachable position generally in the chest region of the user. A circumferential flexible fastener member 128 may be provided having mating VELCRO fastener elements 130, 132 at the opposed ends thereof, respectively. Fastener member 128 is used to circumferentially removably attach the pull cord 122 to shoulder strap 42 without limiting the ability of the user to pull the cord outwardly from supplemental container 100. When this action occurs, valve slide member 110 which is normally maintained in its first or "closed" position by helical spring 120 extending along and around valve stem 116 and engaging the left wall defining axial valve passage 112 and shoulder 118 defined by the increased diameter of valve slide 110, is moved laterally to the left in passage 112 against the resilient bias of spring 120 to the second or "open" position of the valve assembly whereupon the liquid solution in reservoir 100 is allowed to flow through opening 111, nipple 109, tube 108 and into bag interior 30 so long as the user continues to pull on the pull cord ring 126. When the pull cord ring is released, spring 120 will cause the valve slide member 110 to return to its first or "closed position" thereby shutting off the flow of liquid 104 from supplemental container 100 to bag 24. It is thus seen that by virtue of the unique arrangement of parts described above in connection with FIGS. 9 and 10, a runner wearing this modified exemplary form of the harness of the invention may when desired cause a selected amount of enrichment fluid or other liquid to be transferred to bag 24 at any time by merely pulling on cord 122 via pull ring 126 with the amount of fluid being transferred depending upon how long the runner maintains the pull ring activated. Of course, when it is not desired to use the supplemental reservoir 100, the subassembly thereof may be removed by peeling supplemental panel 92 from its VELCRO attachemnts points on shoulder straps 42 and 44, and by releasing circumferential fastener 128 to remove pull cord 122.

It is now believed apparent that the present invention accomplishes all of the objectives set forth by providing a new and improved liquid carrying harness adapted to be fitted about the upper torso of a wearer and to support a liquid carrying bag or other container on the back of the wearer, and which provides further a new and improved liquid carrying harness especially adapted for use during vigorous physical activity and which includes means for enabling the wearer to draw liquid refreshment therefrom during ambulation and which further includes supplemental reservoir means for modifying the liquid substance carried by the harness in a selected manner.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A liquid carrying harness adapted to be worn by a user comprising:

liquid containing means having a bottom, a top, and first and second opposed sides, first strap means attached to the bottom of said containing means, said first strap means adapted to be fastened about the waist of a user, second strap means attached to the top of said containing means, said second strap means adapted to be disposed over the shoulders of said user and removably connected to said first strap means, and flexible tube means connected at one end to said container means whereby said user is adapted to draw liquid from said liquid containing means through another end of said flexible tube means when said harness is worn by said user with said first side of said liquid containing means confronting the user's body, wherein said liquid containing means comprises a flexible bag having a top edge, a pair of opposed side edges and a bottom edge, said first strap means comprises a first pair of opposed strap members, each member having one end thereof attached to a respective one of the opposed side edges of said bag proximal to said bottom edge, and said second strap means comprises a second pair of strap members, each member having one end thereof attached to the top edge of said bag proximal to said opposed side edges respectively, wherein each of said first pair of strap members has a first free end, said first free ends being adapted to be fastened to each other, and wherein each of said second pair of strap members has a second free end, said second free ends being adapted to be attached to a respective one of said first strap members, wherein said bag has a transverse opening proximal to said top edge thereof, said transverse opening extending orthogonally between said pair of second strap members, and further comprising transparent pocket means affixed to said second opposed side of said bag, and a placard bearing identifying indicia insertable within said transparent pocket means so as to be clearly visible to an observer when said user is wearing said liquid carrying harness.

* * * * *